US011365368B2

(12) United States Patent
Nara et al.

(10) Patent No.: US 11,365,368 B2
(45) Date of Patent: Jun. 21, 2022

(54) REFRIGERATOR OIL AND HYDRAULIC FLUID COMPOSITION FOR REFRIGERATORS

(71) Applicant: ENEOS Corporation, Tokyo (JP)

(72) Inventors: Fumiyuki Nara, Tokyo (JP); Yohei Shono, Tokyo (JP); Takeshi Okido, Tokyo (JP); Hidetoshi Ogata, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

(21) Appl. No.: 16/769,342

(22) PCT Filed: Nov. 19, 2018

(86) PCT No.: PCT/JP2018/042642
§ 371 (c)(1),
(2) Date: Jun. 3, 2020

(87) PCT Pub. No.: WO2019/111688
PCT Pub. Date: Jun. 13, 2019

(65) Prior Publication Data

US 2020/0369979 A1 Nov. 26, 2020

(30) Foreign Application Priority Data

Dec. 8, 2017 (JP) ..... JP2017-236189

(51) Int. Cl.
*C10M 171/00* (2006.01)
*C10M 101/02* (2006.01)
(Continued)

(52) U.S. Cl.
CPC ..... *C10M 171/008* (2013.01); *C10M 101/02* (2013.01); *C10M 137/105* (2013.01);
(Continued)

(58) Field of Classification Search
CPC ..... C10M 171/008; C10M 101/02; C10M 137/105; C10M 171/02; C10M 2203/1006; C10M 2223/041; C10N 2040/30
See application file for complete search history.

(56) References Cited

U.S. PATENT DOCUMENTS 4,800,013 A 1/1989 Yamane et al.
7,914,697 B2 3/2011 Kaneko
(Continued)

FOREIGN PATENT DOCUMENTS

CN 1297472 5/2001
CN 1637127 7/2005
(Continued)

OTHER PUBLICATIONS

ISR issued in WIPO Patent Application No. PCT/JP2018/042642, dated Jan. 22, 2019; English translation.
(Continued)

*Primary Examiner* — Taiwo Oladapo
(74) *Attorney, Agent, or Firm* — Greenblum & Bernstein, P.L.C.

(57) ABSTRACT

A refrigerating machine oil having a kinematic viscosity at 100° C. of 0.5 $mm^2/s$ or more and 2.5 $mm^2/s$ or less, a distillation end point in gas chromatography distillation of 380° C. or more and 450° C. or less, and a sulfur content of 0.001 mass % or more and 0.2 mass % or less.

2 Claims, 1 Drawing Sheet

(51) Int. Cl.
*C10M 137/10* (2006.01)
*C10M 171/02* (2006.01)
*C10N 40/30* (2006.01)

(52) U.S. Cl.
CPC .. *C10M 171/02* (2013.01); *C10M 2203/1006* (2013.01); *C10M 2223/041* (2013.01); *C10N 2040/30* (2013.01)

(56) References Cited

U.S. PATENT DOCUMENTS

| | | | | |
|---|---|---|---|---|
| 2007/0213239 | A1 | 9/2007 | Kaneko | |
| 2010/0093568 | A1* | 4/2010 | Tagawa | C10M 169/04 508/133 |
| 2010/0137176 | A1 | 6/2010 | Aoki et al. | |
| 2011/0237477 | A1* | 9/2011 | Tagawa | B01J 29/068 508/469 |
| 2012/0103874 | A1 | 5/2012 | Perez-Cordova | |
| 2013/0130942 | A1* | 5/2013 | Dobson, Jr. | C09K 8/035 507/116 |
| 2015/0060328 | A1 | 3/2015 | Tagawa et al. | |
| 2015/0315454 | A1* | 11/2015 | Perez-Cordova | C09K 8/265 507/103 |
| 2016/0208154 | A1 | 7/2016 | Shimomura et al. | |
| 2018/0044608 | A1 | 2/2018 | Kaneko et al. | |

FOREIGN PATENT DOCUMENTS

| | | | | |
|---|---|---|---|---|
| CN | 1678720 | | 10/2005 | |
| CN | 1696260 | | 11/2005 | |
| CN | 101018844 | | 8/2007 | |
| CN | 101275099 | | 10/2008 | |
| CN | 101400769 | | 4/2009 | |
| CN | 101484560 | | 7/2009 | |
| CN | 102239241 | | 11/2011 | |
| CN | 104981534 | | 10/2015 | |
| CN | 107075398 | | 8/2017 | |
| CN | 107406799 | | 11/2017 | |
| CN | 110249037 | | 9/2019 | |
| EP | 0989179 | | 3/2000 | |
| EP | 1092760 | | 4/2001 | |
| EP | 2135929 | | 12/2009 | |
| EP | 3578626 | | 12/2019 | |
| JP | 62-295995 | A | 12/1987 | |
| JP | 2005-162883 | A | 6/2005 | |
| JP | 2005-325151 | A | 11/2005 | |
| JP | 2007-186638 | A | 7/2007 | |
| JP | 2008-239784 | A | 10/2008 | |
| JP | 2010-090251 | | 4/2010 | |
| WO | 00/60031 | A1 | 10/2000 | |
| WO | 2004/020558 | | 3/2004 | |
| WO | 2006/030490 | A1 | 3/2006 | |
| WO | 2006/062245 | A1 | 6/2006 | |
| WO | 2007/105452 | A1 | 9/2007 | |
| WO | 2014/090757 | | 6/2014 | |
| WO | WO-2016051964 | A1 * | 4/2016 | C10M 105/06 |
| WO | 2016/158307 | A1 | 10/2016 | |

OTHER PUBLICATIONS

Written Opinion issued in WIPO Patent Application No. PCT/JP2018/042642, dated Jan. 22, 2019; English translation.
IPRP issued in WIPO Patent Application No. PCT/JP2018/042642, dated Jun. 18, 2020; English translation.
EESR issued in EP Patent Application No. 18885417.8, dated Aug. 5, 2021.
Office Action issued in Indian Patent Application No. 202017026932 dated Aug. 25, 2021, English Translation.
Haiquan Chen, "Marine Auxiliary Machinery (Fine Textbook Series for Maritime Specialty, Provincial "Twelfth Five-Year Plan" Textbooks for Undergraduates in General Higher Education in Liaoning Province)", Dalian Maritime University Press, Nov. 30, 2016, pp. 305-306, partial English translation.

* cited by examiner

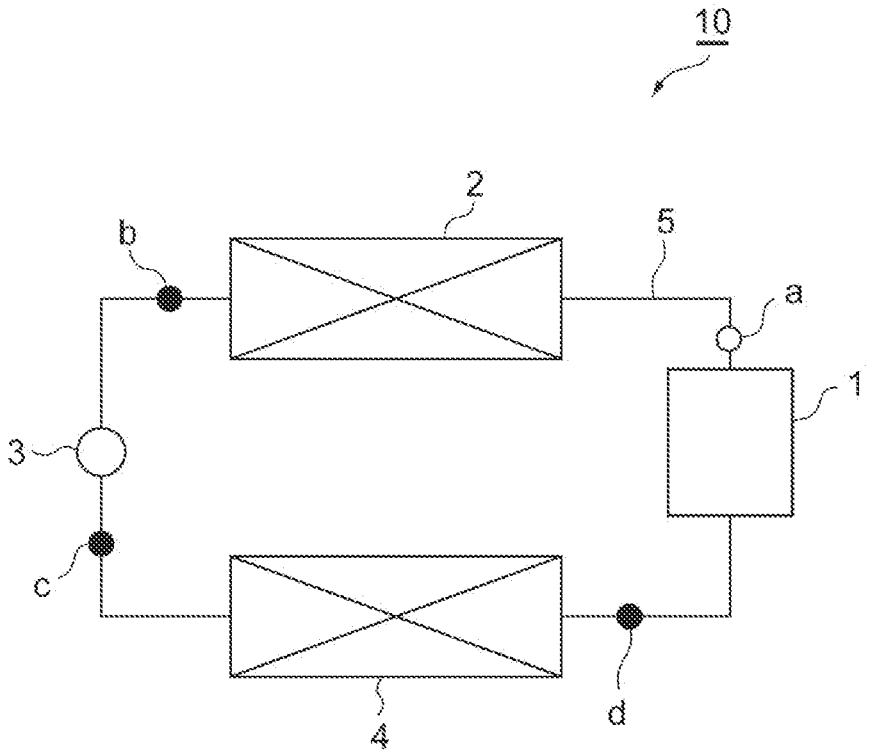
10
2
b
5
a
1
3
c
4
d

REFRIGERATOR OIL AND HYDRAULIC FLUID COMPOSITION FOR REFRIGERATORS

RELATED APPLICATION

This application is a national stage entry of PCT/JP2018/042642, filed Nov. 9, 2018, which is a continuation of Japanese Patent Application No. 2017-236189, filed Dec. 8, 2017, which are incorporated by reference in their entirety.

TECHNICAL FIELD

The present invention relates to a refrigerating machine oil and a working fluid composition for a refrigerating machine.

BACKGROUND ART

A refrigerating machine of a cold storage chamber or an air conditioner is provided with a compressor for circulating a refrigerant in a refrigerant circulation system. The compressor is filled with a refrigerating machine oil for a lubricating sliding member. In general, the lower the viscosity of the refrigerating machine oil is, the lower stirring resistance and the lower friction in a sliding portion can be achieved, so that viscosity reduction of the refrigerating machine oil results in energy saving of the refrigerating machine. In Patent Literature 1, for example, specified refrigerating machine oils in a range of VG 3 or more and VG 8 or less are disclosed.

CITATION LIST

Patent Literature

Patent Literature 1: International Publication No. WO 2006/062245

SUMMARY OF INVENTION

Technical Problem

However, with a refrigerating machine oil having a reduced viscosity, it becomes difficult to maintain an oil film in a sliding portion, so that the abrasion resistance may not be retained. Further, since the refrigerating machine oil is compatible with the refrigerant in a refrigerating machine, the viscosity is greatly reduced at the time of use compared to that of the refrigerating machine oil itself, with lubrication conditions changing from a fluid lubrication region to a mixed lubrication or boundary lubrication region, so that the contact frequency between sliding materials increases. Accordingly, use of an ultra-low viscosity refrigerating machine oil having a kinematic viscosity at 100° C. of 2.5 $mm^2/s$ or less or 2.0 mm/s or less, in particular, has not been sufficiently studied. In particular, in the case of using such an ultra-low viscosity refrigerating machine oil, it is extremely difficult to achieve a refrigerating machine oil having a high abrasion resistance even under severe lubricating conditions such as the mixed lubrication or boundary lubrication conditions.

It is an object of the present invention, in light of these circumstances, to provide a refrigerating machine oil having a low viscosity and high abrasion resistance even under severe lubrication conditions such as mixed lubrication or boundary lubrication conditions, and a working fluid composition for a refrigerating machine containing the refrigerating machine oil.

Solution to Problem

The present invention provides a refrigerating machine oil having a kinematic viscosity at 100° C. of 0.5 $mm^2/s$ or more and 2.5 $mm^2/s$ or less, a distillation end point in gas chromatography distillation of 380° C. or more and 450° C. or less, and a sulfur content of 0.001 mass % or more and 0.2 mass % or less.

The 90% distillation temperature in gas chromatography distillation of the refrigerating machine oil is preferably 270° C. or more and 400° C. or less.

The 95% distillation temperature in gas chromatography distillation of the refrigerating machine oil is preferably 280° C. or more and 410° C. or less.

The difference between the 90% distillation temperature and the 5% distillation temperature in gas chromatography distillation of the refrigerating machine oil is preferably 40° C. or more and 200° C. or less.

The % $C_A$ in n-d-M ring analysis of the refrigerating machine oil is preferably 5 or less.

It is preferable that the refrigerating machine oil contain a lubricating base oil having a sulfur content of 0.001 mass % or more and 0.2 mass % or less.

The present invention also provides a working fluid composition for a refrigerating machine, containing the refrigerating machine oil of the present invention described above and a refrigerant.

Advantageous Effects of Invention

According to the present invention, a refrigerating machine oil having a low viscosity and high abrasion resistance even under severe lubrication conditions such as mixed lubrication or boundary lubrication conditions, and a working fluid composition for a refrigerating machine containing the refrigerating machine oil can be provided.

BRIEF DESCRIPTION OF DRAWINGS

FIG. 1 is a schematic view showing an example of refrigerating machine structure.

DESCRIPTION OF EMBODIMENTS

Embodiments of the present invention are described in detail as follows.

The kinematic viscosity of the refrigerating machine oil at 100° C. is 0.5 $mm^2/s$ or more and 2.5 $mm^2/s$ or less. The kinematic viscosity of the refrigerating machine oil at 100° C. is preferably 0.6 $mm^2/s$ or more and 2.0 $mm^2/s$ or less, more preferably 0.8 $mm^2/s$ or more and 1.5 $mm^2/s$ or less, still more preferably 1.0 $mm^2/s$ or more and 1.4 $mm^2/s$ or less, from the viewpoint of further excellence in balance between the abrasion resistance and the energy saving of the refrigerating machine. The kinematic viscosity in the present invention refers to a kinematic viscosity measured in accordance with JIS K 2283: 2000.

The kinematic viscosity of the refrigerating machine oil at 40° C. may be, for example, 2.0 $mm^2/s$ or more, 2.5 $mm^2/s$ or more, 3.0 $mm^2/s$ or more, or 3.2 $mm^2/s$ or more, and may be, for example, 6.0 $mm^2/s$ or less, 5.0 $mm^2/s$ or less, 4.5 $mm^2/s$ or less, 4.0 $mm^2/s$ or less, or 3.5 $mm^2/s$ or less.

The aniline point of the refrigerating machine oil may be, for example, 60° C. or more, 70° C. or more, 73° C. or more, 76° C. or more, or 80° C. or more from the viewpoint of further excellence in the abrasion resistance. Also, the aniline point of the refrigerating machine oil may be, for example, 100° C. or less, 95° C. or less, or 90° C. or less from the viewpoint of compatibility with organic materials such as polyethylene terephthalate (PET) material and sealing material for use in a refrigeration apparatus (refrigerating machine). The aniline point in the present invention refers to a value measured in accordance with JIS The distillation end point EP in distillation characteristics of the refrigerating machine oil in gas chromatography distillation (hereinafter referred to also as GC distillation) is 380° C. or more and 450° C. or less (referring to distillation characteristics in GC distillation unless otherwise specified). The distillation end point EP of the refrigerating machine oil may be, for example, 390° C. or more, 395° C. or more, or 400° C. or more from the viewpoint of lubricity. The distillation end point EP of the refrigerating machine oil may be, for example, 440° C. or less, 430° C. or less, or 425° C. or less from the viewpoint of further reduction in viscosity.

In the other distillation characteristics of the refrigerating machine oil in gas chromatography distillation, preferably the distillation temperature on the low boiling point is raised high and the distillation temperature on the high boiling point is maintained in an appropriate range from the viewpoint of further excellence in the balance between the viscosity reduction and the lubricity of the refrigerating machine oil, with the flash point being maintained high. It is preferable that such a refrigerating machine oil have the distillation characteristics described below.

The initial boiling point IBP of the refrigerating machine oil may be, for example, 200° C. or more, 210° C. or more, 220° C. or more, or 225° C. or more, and may be, for example, 260° C. or less, 250° C. or less, or 240° C. or less.

The 5% distillation temperature $T_5$ of the refrigerating machine oil may be, for example, 205° C. or more, 215° C. or more, 225° C. or more, or 235° C. or more, and may be, for example, 265° C. or less, 255° C. or less, or 245° C. or less.

The 10% distillation temperature $T_{10}$ of the refrigerating machine oil may be, for example, 210° C. or more, 220° C. or more, 230° C. or more, or 240° C. or more, and may be, for example, 270° C. or less, 260° C. or less, or 250° C. or less.

The 50% distillation temperature $T_{50}$ of the refrigerating machine oil may be, for example, 230° C. or more, 240° C. or more, 250° C. or more, or 260° C. or more, and may be, for example, 310° C. or less, 300° C. or less, or 280° C. or less.

The 70% distillation temperature $T_{70}$ of the refrigerating machine oil may be, for example, 250° C. or more, 260° C. or more, 270° C. or more, or 280° C. or more from the viewpoints of the lubricity and the high flash point. Also, the 70% distillation temperature $T_{70}$ of the refrigerating machine oil may be, for example, 340° C. or less, 330° C. or less, or 300° C. or less from the viewpoint of viscosity reduction.

The 90% distillation temperature $T_{90}$ of the refrigerating machine oil may be, for example, 270° C. or more, 280° C. or more, 290° C. or more, or 300° C. or more, and particularly preferably 320° C. or more, 330° C. or more, or 340° C. or more from the viewpoint of further excellence in the abrasion resistance. Also, the 90% distillation temperature $T_{90}$ of the refrigerating machine oil may be, for example, 400° C. or less, 370° C. or less, 360° C. or less, or 355° C. or less from the same viewpoint described above.

The 95% distillation temperature $T_{95}$ of the refrigerating machine oil may be, for example, 280° C. or more, 290° C. or more, 300° C. or more, 310° C. or more, or 330° C. or more, and particularly preferably 340° C. or more, 350° C. or more, or 360° C. or more from the viewpoint of further excellence in the abrasion resistance. The 95% distillation temperature $T_{95}$ of the refrigerating machine oil may be, for example, 410° C. or less, 400° C. or less, 390° C. or less, or 380° C. or less.

From the viewpoint of further excellence in the balance between viscosity reduction and lubricity of the refrigerating machine oil with the flash point maintained high, as described above, preferably, while the distillation temperature on the low boiling point side is raised high, the distillation temperature on the high boiling point side is maintained in an appropriate range. In addition to the above, it is preferable that the distillation range be maintained in a moderately narrow, but not too narrow, range as described below, rather than making the distillation range wider.

The difference between the 5% distillation temperature $T_5$ and the 90% distillation temperature T % of the refrigerating machine oil ($T_{90}-T_5$) may be, for example, 40° C. or more, 50° C. or more, or 60° C. or more, and particularly preferably 80° C. or more, or 100° C. or more, and may be, for example, 200° C. or less, 160° C. or less, 150° C. or less, 140° C. or less, or 130° C. or less.

The difference between the initial boiling point IBP and the 90% distillation temperature $T_{90}$ of the refrigerating machine oil ($T_{90}$-IBP) may be, for example, 40° C. or more, 50° C. or more, 60° C. or more, or 70° C. or more, and particularly preferably 80° C. or more, or 100° C. or more, and may be, for example, 170° C. or less, 160° C. or less, 150° C. or less, or 140° C. or less.

The difference between the initial boiling point IBP and the 95% distillation temperature $T_{95}$ of the refrigerating machine oil ($T_{95}$-IBP) may be, for example, 50° C. or more, 60° C. or more, 70° C. or more, or 80° C. or more, and particularly preferably 100° C. or more, or 120° C. or more, and may be, for example, 180° C. or less, 170° C. or less, 160° C. or less, or 150° C. or less.

The difference between the 90% distillation temperature $T_{90}$ and the 95% distillation temperature $T_{95}$ of the refrigerating machine oil ($T_{95}$-$T_{90}$) may be, from the viewpoint of lubricity, for example, 1° C. or more, 3° C. or more, 5° C. or more, 10° C. or more, or 20° C. or more, and may be, for example, 100° C. or less, 80° C. or less, 50° C. or less, or 40° C. or less.

The difference between the 90% distillation temperature $T_{90}$ and the distillation end point EP of the refrigerating machine oil (EP-$T_{91}$) may be, from the viewpoint of lubricity, for example, 30° C. or more, 50° C. or more, 60° C. or more, or 70° C. or more, and may be, for example, 150° C. or less, 140° C. or less, 130° C. or less, or 120° C. or less, and particularly preferably 100° C. or less, 90° C. or less, or 80° C. or less.

The initial boiling point, the 5% distillation temperature, the 10% distillation temperature, the 50% distillation temperature, the 70% distillation temperature, the 90% distillation temperature and the distillation end point in the present invention refer to the initial distillation point, the 5% distillation temperature, the 10% distillation temperature, the 50% distillation temperature, the 70% distillation temperature, the 90% distillation temperature, the 95% distillation temperature and the distillation end point measured in accordance with the distillation test method by gas chromatography specified in ASTM D7213-05, respectively.

The sulfur content in the refrigerating machine oil is 0.001 mass % or more and 0.2 mass % or less. The sulfur content in the refrigerating machine oil may be, for example, 0.003 mass % or more, or 0.005 mass % or more from the viewpoint of further excellence in the abrasion resistance, and may be, for example, 0.3 mass % or less, 0.1 mass % or less, or 0.05 mass % or less. The sulfur content in the present invention refers to the sulfur content measured by the ultraviolet fluorescence method specified in JIS K2541-6: 2013.

The composition ratios of the refrigerating machine oil by ring analysis are preferably maintained in the following ranges, from the viewpoint of further excellence in the balance between viscosity reduction and lubricity of the refrigerating machine oil, with the flash point maintained high.

The % $C_P$ of the refrigerating machine oil may be, for example, 15 or more, 40 or more, or 50 or more, and may be, for example, 70 or less, 60 or less, or 55 or less.

The % $C_N$ of the refrigerating machine oil may be, for example, 30 or more, 35 or more, or 40 or more, and may be, for example, 85 or less, 70 or less, 60 or less, 50 or less, or 49 or less.

The ratio of the % $C_N$ to the % $C_P$ (% $C_N$/% $C_P$) of the refrigerating machine oil may be, for example, 0.5 or more, 0.6 or more, or 0.7 or more, and may be, for example, 4.5 or less, 2.0 or less, 1.4 or less, 1.3 or less, or 1.2 or less.

The % $C_A$ of the refrigerating machine oil may be, for example, 8 or less, 5 or less, or 3 or less, from the viewpoint of lubricity and stability, and may be 0, 0.5 or more, or 1 or more.

The % $C_P$, the % $C_N$ and the % $C_A$ in the present invention refer to values measured by the method (n-d-M ring analysis) in accordance with ASTM D3238-95 (2010), respectively.

The flash point of the refrigerating machine oil may be, for example, 100° C. or more, 110° C. or more, or 120° C. or more from the viewpoint of safety, and may be, for example, 155° C. or less, or 145° C. or less from the viewpoint of making a low viscosity oil. The flash point in the present invention refers to the flash point measured in accordance with JIS K 2265-4: 2007 (Cleveland open cup (COC) method).

The pour point of the refrigerating machine oil may be, for example, −10° C. or less or −20° C. or less and may be −40° C. or more from the viewpoint of refining cost, though −50° C. or less may be acceptable. The pour point in the present invention refers to the pour point measured in accordance with JIS K 2269: 1987.

The acid value of the refrigerating machine oil may be, for example, 1.0 mg KOH/g or less, or 0.1 mg KOH/g or less. The acid value in the present invention refers to the acid value measured in accordance with JIS K 2501: 2003.

The volume resistivity of the refrigerating machine oil may be, for example, $1.0\times10^{9}$ Ω·m or more, $1.0\times10^{10}$ Ω·m or more, or $1.0\times10^{11}$ Ω·m or more. The volume resistivity in the present invention refers to the volume resistivity at 25° C. measured in accordance with JIS C2101: 1999.

The water content of the refrigerating machine oil may be, for example, 200 ppm or less, 100 ppm or less, or 50 ppm or less based on the total amount of the refrigerating machine oil.

The ash content of the refrigerating machine oil may be, for example, 100 ppm or less, or 50 ppm or less. The ash content in the present invention refers to the ash content measured in accordance with JIS K2272: 1998.

The refrigerating machine oil having the characteristics described above contains, for example, a lubricating base oil and a lubricant additive. Examples of the lubricating base oil include mineral oils. The mineral oils may be produced by refining lubricant fractions obtained by atmospheric distillation and vacuum distillation of crude oils such as paraffinic and naphthenic crude oils, using a method such as solvent deasphalting, solvent refining, hydrorefining, hydrocracking, solvent dewaxing, hydrodewaxing, clay treatment, and sulfuric acid washing. These refining methods may be used alone or in combination of two or more. As the lubricating base oil, from the viewpoint of availability, preferably, a low-viscosity lubricating base oil for general use as solvent, diluent, or metalworking oil is appropriately selected and used.

In order to produce a refrigerating machine oil having the characteristics described above, it is preferable that the characteristics of the lubricating base oil as the main component (for example, 90 mass % or more) be equivalent to those described above, unless otherwise specified in the present specification. Accordingly, characteristic ranges for each item of the lubricating base oil contained in the refrigerating machine oil may be replaced with the characteristic ranges for each item of the refrigerating machine oil described above, unless otherwise specified in the present specification. For example, the distillation characteristics of the lubricating base oil in GC distillation are not particularly limited as long as the distillation characteristics of the refrigerating machine oil are in the ranges described above. The specifications ranging from the initial boiling point IBP to the 90% distillation temperature $T_{90}$ of the lubricating base oil and the specifications related thereto are hardly affected by blending of additives, and may be therefore replaced with, for example, approximately the same distillation characteristics of the refrigerating machine oil described above or ranges within ±5° C. The distillation end point EP of the lubricating base oil may be, for example, 450° C. or less, and the 95% distillation temperature $T_{95}$ may be, for example, 410° C. or less.

The lubricating base oil may consist of the mineral oil described above, or the proportion of the mineral oil may be, usually 50 mass % or more, 70 mass % or more, or 90% by mass based on the total amount of the lubricating base oil. In addition to the mineral oil described above, a hydrocarbon oil such as alkylbenzene or an oxygen-containing oil such as ester may be further contained, as long as the effects of the present invention are not significantly impaired.

The alkylbenzene may be at least one selected from the group consisting of the following alkylbenzene (a1) and alkylbenzene (a2).

Alkylbenzene (a1): an alkylbenzene having 1 to 4 alkyl groups each having 1 to 19 carbon atoms, the alkyl groups as a whole having 9 to 19 carbon atoms in total (preferably, an alkylbenzene having 1 to 4 alkyl groups each having 1 to 15 carbon atoms, the alkyl groups as a whole having 9 to 15 carbon atoms in total).

Alkylbenzene (a2): an alkylbenzene having 1 to 4 alkyl groups each having 1 to 40 carbon atoms, the alkyl groups as a whole having 20 to 40 carbon atoms in total (preferably, an alkylbenzene having 1 to 4 alkyl groups each having 1 to 30 carbon atoms, the alkyl groups as a whole having 20 to 30 carbon atoms in total).

The ester may be, for example, an ester of a monohydric alcohol or a dihydric alcohol and a fatty acid. The monohydric alcohol or the dihydric alcohol may be, for example, an aliphatic alcohol having 4 to 12 carbon atoms. The fatty acid may be, for example, a fatty acid having 4 to 19 carbon atoms.

The kinematic viscosity of the lubricating base oil at 40° C. may be, for example, 2.0 $mm^2/s$ or more, 2.5 $mm^2/s$ or more, or 2.7 $mm^2/s$ or more, and may be, for example, 4.5 $mm^2/s$ or less, 4.0 $mm^2/s$ or less, or 3.5 $mm^2/s$ or less. The kinematic viscosity of the lubricating base oil at 100° C. may be, for example, 0.5 $mm^2/s$ or more, 0.6 $mm^2/s$ or more, 0.8 $mm^2/s$ or more, or 1.0 $mm^2/s$ or more, and may be, for example, 2.5 $mm^2/s$ or less, 2.0 $mm^2/s$ or less, 1.5 $mm^2/s$ or less, or 1.3 $mm^2/s$ or less.

The sulfur content of the lubricating base oil may be 0.001 mass % or more and 0.2 mass % or less from the viewpoint of further excellence in the abrasion resistance. The sulfur content of the lubricating base oil may be, for example, 0.003 mass % or more, or 0.005 mass % or more, and may be, for example, 0.1 mass % or less, 0.05 mass % or less, 0.03 mass % or less, or less than 0.02 mass %.

The content of the lubricating base oil may be, for example, 50 mass % or more, 60 mass % or more, 70 mass % or more, 80 mass % or more, 90 mass % or more, or 95 mass % or more, based on the total amount of the refrigerating machine oil, and may be, for example, 99.9 mass % or less, 99.5 mass % or less, 99 mass % or less, or 98.5 mass % or less.

Examples of the lubricant additives include an acid scavenger, an antioxidant, an extreme pressure agent, an oily agent, an antifoaming agent, a metal deactivator, an antiwear agent, a viscosity index improver, a pour point depressant, and a detergent dispersant. The content of these lubricant additives may be 10 mass % or less or 5 mass % or less based on the total amount of the refrigerating machine oil.

The refrigerating machine oil may contain an extreme pressure agent especially among the additives described above from the viewpoint of further excellence in abrasion resistance. Preferred examples of the extreme pressure agent include a phosphorus-based extreme pressure agent. The phosphorus-based extreme pressure agent may be classified into, for example, an extreme pressure agent containing sulfur and phosphorus (first extreme pressure agent) and an extreme pressure agent containing phosphorus but not containing sulfur (second extreme pressure agent). Examples of the first extreme pressure agent preferably include a thiophosphoric acid ester. Preferred examples of the sulfur-free second extreme pressure agent include a phosphoric acid ester, an acidic phosphoric acid ester, an amine salt of an acidic phosphoric acid ester, a chlorinated phosphoric acid ester, and a phosphorous acid ester.

Examples of the thiophosphoric acid ester include tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyl diphenyl phosphorothionate, and xylenyl diphenyl phosphorothionate. Among these, triphenyl phosphorothionate is preferred.

Examples of the phosphoric acid ester include tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, tri(ethylphenyl) phosphate, tri(butylphenyl) phosphate, trixylenyl phosphate, cresyl diphenyl phosphate, and xylenyl diphenyl phosphate. Among these, triphenyl phosphate and tricresyl phosphate are preferred.

Examples of the acidic phosphoric acid ester include monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate and monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate, and dioleyl acid phosphate.

Examples of the amine salt of an acidic phosphoric acid ester include a salt of the acidic phosphoric acid ester described above with an amine such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine, and trioctylamine.

Examples of the chlorinated phosphoric acid ester include tris-dichloropropyl phosphate, tris-chloroethyl phosphate, tris-chlorophenyl phosphate, and polyoxyalkylene bis[di(chloroalkyl)]phosphate. Examples of the phosphite esters include dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, torinonyl phosphite, tridecyl phosphite, triundecyl phosphite, tridodecyl phosphite, trioleyl phosphite, triphenyl phosphite, and tricresyl phosphite.

The content of the extreme pressure agent may be, for example, 0.1 mass % or more, 1 mass % or more, 1.5 mass % or more, or 1.6 mass % or more based on the total amount of the refrigerating machine oil, from the viewpoint of further excellent in abrasion resistance, and may be, for example, 5 mass % or less, 3 mass % or less, 2.5 mass % or less, or 2 mass % or less.

In the case where the first extreme pressure agent and the second extreme pressure agent are used in combination as an extreme pressure agent, the proportion of the content of the first extreme pressure agent may be, for example, 5 mass % or more, 8 mass % or more, or 10 mass % or more, based on the total amount of the first extreme pressure agent and the second extreme pressure agent, from the viewpoint of further excellence in abrasion resistance, and may be, for example, 20 mass % or less, 18 mass % or less, 15 mass % or less, or 14 mass % or less.

The content of the first extreme pressure agent may be, for example, 0.01 mass % or more, 0.05 mass % or more, or 0.1 mass % or more, based on the total amount of the refrigerating machine oil, from the viewpoint of further excellence in abrasion resistance, and may be, for example, 1 mass % or less, 0.5 mass % or less, or 0.4 mass % or less. The content of the second extreme pressure agent may be, for example, 0.5 mass % or more, 1 mass % or more, or 1.2 mass % or more, based on the total amount of the refrigerating machine oil, from the viewpoint of further excellence in abrasion resistance, and may be, for example, 5 mass % or less, 3 mass % or less, 2.0 mass % or less, or 1.8 mass % or less.

The refrigerating machine oil of the present embodiment is usually present in a state of working fluid composition for a refrigerating machine mixed with a refrigerant in a refrigerating machine. In other words, the working fluid composition for a refrigerating machine of the present embodiment contains the refrigerating machine oil described above and a refrigerant. The content of the refrigerating machine oil in the working fluid composition for a refrigerating machine may be 1 to 500 parts by mass or 2 to 400 parts by mass relative to 100 parts by mass of the refrigerant.

Examples of the refrigerant include a hydrocarbon refrigerant, a saturated fluorinated hydrocarbon refrigerant, an unsaturated fluorinated hydrocarbon refrigerant, a fluorine-containing ether refrigerant such as perfluoroethers, a bis (trifluoromethyl)sulfide refrigerant, a difluorinated methane iodide refrigerant, and a natural refrigerant such as ammonia and carbon dioxide.

The hydrocarbon refrigerant is preferably a hydrocarbon having 1 to 5 carbon atoms, more preferably a hydrocarbon having 2 to 4 carbon atoms. Specific examples of the hydrocarbon include methane, ethylene, ethane, propylene, propane (R290), cyclopropane, normal butane, isobutane (R600a), cyclobutane, methylcyclopropane, 2-methylbutane, normal pentane, and a mixture of two or more thereof. Among them, the hydrocarbon refrigerant is preferably a hydrocarbon refrigerant which is in a gas state at 25° C. and 1 atm, more preferably propane, normal butane, isobutane, 2-methyl butane or a mixture thereof.

The saturated fluorinated hydrocarbon refrigerant is preferably a saturated fluorinated hydrocarbon having 1 to 3 carbon atoms, more preferably 1 to 2 carbon atoms. Specific examples of the saturated fluorinated hydrocarbon refrigerant include difluoromethane (R32), trifluoromethane (R23), pentafluoroethane (R125), 1,1,2,2-tetrafluoroethane (R134), 1,1,1,2-tetrafluoroethane (R134a), 1,1,1-trifluoroethane (R143a), 1,1-difluoroethane (R152a), fluoroethane (R161), 1,1,1,2,3,3,3-heptafluoropropane (R227ea), 1,1,1,2,3,3-hexafluoropropane (R236ea), 1,1,1,3,3,3-hexafluoropropane (R236fa), 1,1,1,3,3-pentafluoropropane (R245fa) and 1,1,1,3,3-pentafluorobutane (R365mfc), or a mixture of two or more thereof.

The saturated fluorinated hydrocarbon refrigerant is appropriately selected from the above corresponding to application and required performance. The saturated fluorinated hydrocarbon refrigerant may be, for example, R32 alone; R23 alone; R134a alone; R125 alone; a mixture at a ratio of R134a/R32=60 to 80 mass %/40 to 20 mass %; a mixture at a ratio of R32/R125=40 to 70 mass %/60 to 30 mass %; a mixture at a ratio of R125/R143a=40 to 60 mass %/60 to 40 mass %; a mixture at a ratio of R134a/R32/R125=60 mass %/30 mass %/10 mass %; a mixture at a ratio of R134a/R32/R125=40 to 70 mass %/15 to 35 mass %/5 to 40 mass %; and a mixture at a ratio of R125/R134a/R143a=35 to 55 mass %/1 to 15 mass %/40 to 60 mass %. More specifically, the saturated fluorinated hydrocarbon refrigerant may be a mixture at a ratio of R134a/R32=70/30 mass %; a mixture at a ratio of R32/R125=60/40 mass %; a mixture at a ratio of R32/R125=50/50 mass % (R410A); a mixture at a ratio of R32/R125=45/55 mass % (R410B); a mixture at a ratio of R125/R143a=50/50 mass % (R507C); a mixture at a ratio of R32/R125/R134a=30/10/60 mass %; a mixture at a ratio of R32/R125/R134a=23/25/52 mass % (R407C); a mixture at a ratio of R32/R125/R134a=25/15/60 mass % (R407E); and a mixture of at a ratio of R125/R134a/R143a=44/4/52 mass % (R404A).

The unsaturated fluorinated hydrocarbon (HFO) refrigerant is preferably an unsaturated fluorinated hydrocarbon having 2 to 3 carbon atoms, more preferably fluoropropene, still more preferably fluoropropene having 3 to 5 fluorine atoms. The unsaturated fluorinated hydrocarbon refrigerant is preferably one or a mixture of two or more of 1,2,3,3,3-pentafluoropropene (HFO-1225ye), 1,3,3,3-tetrafluoropropene (HFO-1234ze), 2,3,3,3-tetrafluoropropene (HFO-1234yf), 1,2,3,3-tetrafluoropropene (HFO-1234ye), and 3,3,3-trifluoropropene (HFO-1243zf). The unsaturated fluorinated hydrocarbon refrigerant is preferably one or more selected from HFO-1225ye, HFO-1234ze and HFO-1234yf from the viewpoint of physical properties of the refrigerant. The unsaturated fluorinated hydrocarbon refrigerant may be fluoroethylene, preferably 1,1,2,3-trifluoroethylene.

Among these refrigerants, a refrigerant with a low global warming potential (GWP) is preferred in order to reduce the impact on the global environment. Examples of the refrigerant include an unsaturated fluorinated hydrocarbon refrigerant and a mixed refrigerant with a GWP of 1000 or less, containing at least one selected from a natural refrigerant such as R290 and R600a. The GWP of these refrigerants may be 500 or less, 100 or less, 50 or less, or 10 or less.

It is preferable that the boiling point of these refrigerants be, for example, 0° C. or less and −60° C. or more from the viewpoint of cooling capacity. In particular, −30° C. or less is more preferred from the viewpoint of high-volume capacity with low compression ratio, while −30° C. or more is more preferred from the viewpoint of small sliding loss of a compressor with a low pressure. Examples of the refrigerant having a high-volume capacity with a low compression ratio include R290 (boiling point: −42.1° C.), and examples of the refrigerant having small sliding loss of a compressor with low pressure include R600a (boiling point: −11.6° C.). It is particularly preferable to use R600a from the viewpoint that improvement in efficiency of the refrigerating machine can be expected due to reduction in the sliding loss of a compressor along with viscosity reduction of the refrigerating machine oil.

The refrigerating machine oil and the hydraulic fluid composition for a refrigerating machine of the present embodiment are suitably used in, for example, a refrigerating machine of an air conditioner, a cold storage chamber, an open or closed type car air-conditioner, a dehumidifier, a water heater, a freezer, a cold storage warehouse, a vending machine, a showcase, a chemical plant or the like, which has a reciprocal or rotary type closed compressor, and a refrigerating machine which has a centrifugal compressor.

FIG. 1 is a schematic view showing an example of a refrigerating machine structure to which the refrigerating machine oil and the working fluid composition for a refrigerating machine of the present embodiment are applied. As shown in FIG. 1, a refrigerating machine 10 is provided with at least a refrigerant circulation system having, for example, a refrigerant compressor 1, a gas cooler 2, an expansion mechanism 3 (a capillary, an expansion valve, etc.), and an evaporator 4 which are sequentially connected through a flow channel 5. In the refrigerant circulation system, first, the refrigerant at high temperature (usually 70 to 120° C.) discharged from the refrigerant compressor 1 into the flow channel 5 is turned into a high-density fluid (supercritical fluid or the like) in the gas cooler 2. Subsequently, the refrigerant is liquefied when passing through a narrow flow channel of the expansion mechanism 3 and then cooled to a low temperature (usually −40 to 0° C.) through evaporation in the evaporator 4.

In the refrigerant compressor 1 in FIG. 1, a small amount of refrigerant and a large amount of refrigerating machine oil coexist under high temperature (usually 70 to 120° C.) conditions. The refrigerant discharged from the refrigerant compressor 1 to the flow channel 5 is in a gas state and contains a small amount (usually 1 to 10%) of refrigerating machine oil as mist. In the refrigerating machine oil in a mist state, a small amount of refrigerant is dissolved (point "a" in FIG. 1). Then, in the gas cooler 2, the refrigerant in a gas state is compressed into a high density fluid, so that a large amount of the refrigerant and a small amount of the refrigerating machine oil coexist under relatively high temperature (about 50 to 70° C.) conditions (point "b" in FIG. 1). Further, the mixture of a large amount of the refrigerant and a small amount of the refrigerating machine oil is sent to the expansion mechanism 3 and the evaporator 4 in sequence so as to be rapidly cooled to low temperature (usually −40 to 0° C.) (points "c" and "d" in FIG. 1), and returned to the refrigerant compressor 1 again.

The refrigerating machine oil and the hydraulic fluid composition for a refrigerating machine of the present embodiment can be used together with the refrigerant described above, and particularly suitably used with a hydrocarbon refrigerant from the viewpoint of the cold temperature characteristics and compatibility during refrigerant mixing.

EXAMPLES

The present invention is more specifically described with reference to Examples as follows, though the present invention is not limited to the following Examples.

As the lubricating base oils, commercially available base oils 1 to 6 having characteristics shown in Table 1 were prepared.

TABLE 1

| | | Base oil 1 | Base oil 2 | Base oil 3 | Base oil 4 | Base oil 5 | Base oil 6 |
|---|---|---|---|---|---|---|---|
| Kinematic viscosity at 100° C. | $mm^2/s$ | 1.0 | 1.3 | 2.2 | 1.2 | 2.2 | 2.2 |
| Kinematic viscosity at 40° C. | $mm^2/s$ | 2.3 | 3.3 | 7.5 | 2.9 | 8.7 | 8.1 |
| Acid value | mgKOH/g | <0.01 | <0.01 | <0.01 | <0.01 | <0.01 | <0.01 |
| Pour point | ° C. | −25 | −37.5 | <−40 | <−40 | <−40 | −32.5 |
| Sulfur content | mass % | <0.001 | <0.001 | <0.001 | 0.007 | 0.009 | 0.025 |
| Flash point COC | ° C. | 108 | 130 | 160 | 106 | 148 | 166 |
| n-d-M Ring analysis | % $C_A$ | 4.2 | 1.8 | 0 | 0.5 | 9.2 | 8.6 |
| | % $C_P$ | 59.1 | 44.9 | 60.5 | 18.4 | 32.9 | 54.2 |
| | % $C_N$ | 36.7 | 53.3 | 39.5 | 81.1 | 57.9 | 37.2 |
| | % $C_N$/% $C_P$ | 0.6 | 1.2 | 0.7 | 4.4 | 1.8 | 0.7 |

From the base oils 1 to 6 and additives shown below, refrigerating machine oils having compositions and characteristics shown in Tables 2 and 3 were prepared (Examples 1 to 9 and Comparative Examples 1 to 2). In the tables, ones with plurality of base oil numbers (for example, "base oils 1, 2, 6" in Example 1) refer to a mixed base oil prepared by mixing the respective base oils. Further, in Table 2 and Table 3, "A/(A+B)×100" refers to a proportion of the first extreme pressure agent (component A) based on the total amount of the first extreme pressure agent (component A) and the second extreme pressure agent (component B).

[Additives]

(First Extreme Pressure Agent)

A: triphenyl phosphorothionate (Second Extreme Pressure Agent)

B1: tricresyl phosphate

B2: tri(butylphenyl)phosphate (Abrasion Resistance Test)

Abrasion resistance of each of the refrigerating machine oils in Examples and Comparative Examples as test oil was evaluated by the following procedure. The results are shown in Table 2 and Table 3.

The abrasion resistance test was conducted according to a high speed four-ball test in accordance with ASTM D4172-94. Using SUJ2 as a hard ball, the test was carried out under conditions with a test oil amount of 20 ml, a test temperature of 80° C., a rotation speed of 1200 rpm, an applied load of 196 N, and a test time of 15 minutes. The evaluation of abrasion resistance was based on the average value of the abrasion trace diameter (mm) of a fixed ball. The contact pressure at this time was about 2.3 GPa, and the circumferential speed was calculated to be about 36 cm/s. In the case where the average value of the abrasion trace diameters under these conditions is 0.7 mm or less, it can be said that the refrigerating machine oil has high abrasion resistance even under severe lubrication conditions such as mixed lubrication or boundary lubrication conditions. The average value of the abrasion trace diameter is preferably 0.5 mm or less, more preferably 0.45 mm or less, still more preferably 0.4 mm or less.

TABLE 2

| | | | Example 1 | Example 2 | Example 3 | Example 4 | Example 5 |
|---|---|---|---|---|---|---|---|
| Base oil | | | Base oil 1, 2, 6 | Base oil 1, 4, 5 | Base oil 1, 6 | Base oil 4 | Base oil 1, 2, 6 |
| Composition of refrigerating machine oil | Base oil | mass % | Balance | Balance | Balance | Balance | Balance |
| | A | | — | — | — | — | 0.1 |
| | B1 | | 1.7 | 1.7 | 0.5 | 1.7 | 1.5 |
| | B2 | | — | — | — | — | — |
| A/(A + B) × 100 | | mass % | 0 | 0 | 0 | 0 | 6.3 |
| Kinematic viscosity at 100° C. | | $mm^2/s$ | 1.2 | 1.2 | 1.7 | 1.3 | 1.2 |
| Kinematic viscosity at 40° C. | | | 3.2 | 2.8 | 5.2 | 3.0 | 3.2 |
| Flash point COC | | ° C. | 130 | 106 | 136 | 106 | 131 |
| Pour point | | | −35 | <−40 | −32.5 | <−40 | −35 |
| Aniline point | | | 81 | 65 | 80 | 60 | 80 |
| Distillation characteristics in gas chromatography | IBP | | 229 | 213 | 235 | 189 | 229 |
| | $T_5$ | | 239 | 219 | 242 | 204 | 239 |
| | $T_{10}$ | | 245 | 224 | 248 | 210 | 244 |
| | $T_{50}$ | | 272 | 245 | 309 | 241 | 271 |
| | $T_{70}$ | | 289 | 256 | 338 | 254 | 287 |
| | $T_{90}$ | | 347 | 283 | 366 | 269 | 345 |
| | $T_{95}$ | | 376 | 375 | 374 | 279 | 374 |
| | EP | | 428 | 428 | 404 | 410 | 426 |
| | $T_{90} - T_5$ | | 108 | 64 | 124 | 65 | 106 |
| | $T_{90}$ − IBP | | 118 | 70 | 131 | 80 | 116 |
| | $T_{95}$ − IBP | | 148 | 162 | 140 | 90 | 145 |
| | $T_{95} - T_{90}$ | | 29 | 92 | 8 | 10 | 29 |
| | EP − $T_{90}$ | | 81 | 145 | 38 | 141 | 81 |
| Sulfur content | Total | mass % | 0.005 | 0.005 | 0.018 | 0.007 | 0.014 |
| | Base oil | | 0.005 | 0.005 | 0.018 | 0.007 | 0.005 |
| n-d-M Ring analysis | % $C_A$ | | 4.0 | 2.2 | 7.4 | 0.5 | 4.0 |
| | % $C_P$ | | 51.7 | 30.6 | 55.6 | 18.4 | 51.7 |
| | % $C_N$ | | 44.3 | 67.3 | 37.1 | 81.1 | 44.3 |
| | % $C_N$/% $C_P$ | | 0.9 | 2.2 | 0.7 | 4.4 | 0.9 |
| Abrasion resistance (abrasion trace diameter) | | WSD, mm | 0.480 | 0.55 | 0.485 | 0.494 | 0.487 |

TABLE 3

| | | | Example 6 | Example 7 | Example 8 | Example 9 | Comparative Example 1 | Comparative Example 2 |
|---|---|---|---|---|---|---|---|---|
| Base oil | | | Base oil 1, 2, 6 | Base oil 1, 2, 6 | Base oil 1, 2, 6 | Base oil 2 | Base oil 2 | Base oil 1, 2, 3 |
| Composition of refrigerating machine oil | Base oil | | Balance | Balance | Balance | Balance | Balance | Balance |
| | A | | 0.2 | 0.3 | 0.2 | 0.3 | — | — |
| | B1 | | 1.5 | 1.5 | — | 1.5 | 1.7 | 1.7 |
| | B2 | | — | — | 1.5 | — | — | — |
| A/(A + B) × 100 | | mass % | 11.8 | 16.7 | 11.8 | 16.7 | 0 | 0 |
| Kinematic viscosity at 100° C. | | $mm^2/s$ | 1.3 | 1.2 | 1.3 | 1.3 | 1.3 | 1.2 |
| Kinematic viscosity at 40° C. | | | 3.4 | 3.2 | 3.4 | 3.3 | 3.3 | 3.1 |
| Flash point COC | | ° C. | 131 | 131 | 131 | 131 | 130 | 126 |
| Pour point | | | −35 | −35 | −35 | −40 | −40 | −30 |
| Aniline point | | | 80 | 80 | 80 | 78 | 78 | 83 |
| Distillation characteristics in gas chromatography | IBP | | 230 | 229 | 230 | 229 | 229 | 233 |
| | $T_5$ | | 240 | 239 | 240 | 246 | 246 | 240 |
| | $T_{10}$ | | 246 | 244 | 246 | 252 | 252 | 243 |
| | $T_{50}$ | | 274 | 271 | 274 | 275 | 275 | 264 |
| | $T_{70}$ | | 292 | 287 | 292 | 285 | 285 | 276 |
| | $T_{90}$ | | 350 | 345 | 350 | 295 | 295 | 314 |
| | $T_{95}$ | | 378 | 374 | 378 | 300 | 300 | 347 |
| | EP | | 424 | 426 | 424 | 410 | 410 | 406 |
| | $T_{90} - T_5$ | | 110 | 106 | 110 | 49 | 49 | 74 |
| | $T_{90}$ − IBP | | 120 | 116 | 120 | 67 | 67 | 81 |
| | $T_{95}$ − IBP | | 148 | 145 | 148 | 71 | 71 | 114 |
| | $T_{95} - T_{90}$ | | 27 | 29 | 27 | 4 | 4 | 33 |
| | EP − $T_{90}$ | | 74 | 81 | 74 | 115 | 115 | 92 |
| Sulfur content | Total | mass % | 0.025 | 0.033 | 0.025 | 0.028 | <0.0001 | <0.0001 |
| | Base oil | | 0.006 | 0.005 | 0.006 | <0.0001 | <0.0001 | <0.0001 |

TABLE 3-continued

| | | Example 6 | Example 7 | Example 8 | Example 9 | Comparative Example 1 | Comparative Example 2 |
|---|---|---|---|---|---|---|---|
| n-d-M Ring analysis | % $C_A$ | 4.3 | 4.0 | 4.3 | 1.8 | 1.8 | 1.9 |
| | % $C_P$ | 52.6 | 51.7 | 52.6 | 44.9 | 44.9 | 50.2 |
| | % $C_N$ | 43.1 | 44.3 | 43.1 | 53.3 | 53.3 | 47.9 |
| | % $C_N$/% $C_P$ | 0.8 | 0.9 | 0.8 | 1.2 | 1.2 | 1.0 |
| Abrasion resistance (abrasion trace diameter) | WSD, mm | 0.398 | 0.453 | 0.468 | 0.552 | 1.012 | 1.053 |

(Two-Layer Separation Temperature During Mixing with Hydrocarbon Refrigerant)

Further, the two-layer separation temperature of the refrigerating machine oil used in each of Examples was measured in accordance with JASK 2211: 2009 Appendix D "Refrigerant compatibility test method", using isobutane (R600a) as the refrigerant at a test oil concentration of 10 mass %. At this time, the two-layer separation temperature was −50° C. or lower, so that it was confirmed that the refrigerating machine oil used in Examples was usable as refrigerating machine oil for a hydrocarbon refrigerant.

REFERENCE SIGNS LIST

1: REFRIGERANT COMPRESSOR, 2: A GAS COOLER, 3: EXPANSION MECHANISM, 4: EVAPORATOR, 5: FLOW CHANNEL, 10: REFRIGERATING MACHINE

The invention claimed is:

1. A working fluid composition for a refrigerating machine comprising:

a refrigerating machine oil having a kinematic viscosity at 100° C. of 0.5 $mm^2/s$ or more and 2.5 $mm^2/s$ or less, an initial boiling point in gas chromatography distillation of 250° C. or less, a distillation end point in gas chromatography distillation of 380° C. or more and 450° C. or less, an aniline point of 100° C. or less, a % $C_A$ in n-d-M ring analysis of 5 or less, and a sulfur content of 0.001 mass % or more and 0.2 mass % or less; and a refrigerant.

2. The working fluid composition for a refrigerating machine according to claim 1, wherein the refrigerating machine oil has an initial boiling point in gas chromatography distillation of 240° C. or less.

* * * * *